US010966491B2

(12) United States Patent
Lee

(10) Patent No.: US 10,966,491 B2
(45) Date of Patent: Apr. 6, 2021

(54) ZIPPER FASTENER

(71) Applicant: Ji Hye Lee, Changwon-si (KR)

(72) Inventor: Ji Hye Lee, Changwon-si (KR)

( * ) Notice: Subject to any disclaimer, the term of this patent is extended or adjusted under 35 U.S.C. 154(b) by 0 days.

(21) Appl. No.: 16/540,945

(22) Filed: Aug. 14, 2019

(65) Prior Publication Data

US 2019/0365058 A1 Dec. 5, 2019

Related U.S. Application Data

(63) Continuation of application No. PCT/KR2018/015409, filed on Dec. 6, 2018.

(51) Int. Cl.
*A44B 19/26* (2006.01)

(52) U.S. Cl.
CPC ..... *A44B 19/262* (2013.01)

(58) Field of Classification Search
CPC .. A44B 19/262; A44B 19/285; Y10T 24/2586
See application file for complete search history.

(56) References Cited

U.S. PATENT DOCUMENTS 2,221,759 A * 11/1940 Erard ..... A44B 19/262 24/431
4,815,176 A * 3/1989 Yoshida ..... A44B 19/301 24/387
5,068,950 A * 12/1991 Yuki ..... A44B 19/262 24/429
5,195,221 A * 3/1993 Kanamaru ..... A44B 19/26 24/419
5,611,121 A * 3/1997 Akeno ..... A44B 19/308 24/423
5,848,455 A * 12/1998 Ikehara ..... A44B 19/306 24/422
6,523,232 B2 * 2/2003 Chen ..... A44B 19/26 24/418

(Continued)

FOREIGN PATENT DOCUMENTS

KR 10-2002-0002272 A 1/2002
KR 10-0572280 B1 4/2006

(Continued)

OTHER PUBLICATIONS

International Search Report issued in PCT/KR2018/015409; dated Mar. 11, 2019.

*Primary Examiner* — Robert Sandy
*Assistant Examiner* — Louis A Mercado
(74) *Attorney, Agent, or Firm* — Studebaker & Brackett PC

(57) ABSTRACT

The present disclosure relates to a zipper fastener including: an upper plate; a lower plate disposed to correspond to the upper plate; a head disposed in a predetermined region of an upper surface of the upper plate; and a pull body configured to be fastened to the head. The head includes a body portion and a flange portion extending to one side end of the body portion. The pull body includes a main body portion. The main body portion includes a main body portion lower surface disposed at a lower portion of the main body portion, a main body portion first side surface disposed at a first side of the main body portion, and a main body portion second side surface disposed at a second side of the main body portion and disposed to face the main body portion first side surface.

6 Claims, 19 Drawing Sheets

(56) References Cited

U.S. PATENT DOCUMENTS

| | | | | |
|---|---|---|---|---|
| 7,114,223 | B2 | 10/2006 | Okot | |
| 7,360,285 | B2 * | 4/2008 | Takazawa | A44B 19/308 24/420 |
| 7,404,240 | B2 * | 7/2008 | Nedbal | A44B 19/262 24/415 |
| 7,891,061 | B2 * | 2/2011 | Lin | A44B 19/308 24/424 |
| 8,819,901 | B2 * | 9/2014 | Muratsubaki | A41F 1/008 24/381 |
| 9,095,192 | B2 * | 8/2015 | Hamada | A44B 19/306 |
| 2002/0000025 | A1 | 1/2002 | Yamagishi | |
| 2005/0125968 | A1 | 6/2005 | Yamazaki | |

FOREIGN PATENT DOCUMENTS

| | | | |
|---|---|---|---|
| KR | 20-0422256 | Y1 | 7/2006 |
| KR | 10-2007-0026725 | A | 3/2007 |

* cited by examiner

-- PRIOR ART --

-- PRIOR ART --

ZIPPER FASTENER

CROSS REFERENCE TO RELATED APPLICATION

The present application is a continuation of International Patent Application No. PCT/KR2018/015409, filed Dec. 6, 2018, which is based upon and claims the benefit of priority to Korean Patent Application No. 10-2017-0180391, filed Dec. 27, 2017, and Korean Patent Application No. 10-2018-0089164 filed on Jul. 31, 2018. The disclosures of the above-listed applications are hereby incorporated by reference herein in their entirety.

TECHNICAL FIELD

The present invention relates to a zipper fastener, and more particularly, to a zipper fastener in which a pull tab is replaceable.

BACKGROUND ART

Generally, zippers have been used by being formed at openings of clothes in order to facilitate putting on and taking off of clothes such as dresses, jumpers, and trousers.

A zipper includes a pair of support tapes formed at both sides of an opening.

A pair of chains arranged to be spaced apart at a predetermined interval in a longitudinal direction are respectively formed at the support tapes. A zipper fastener is used in order to couple or separate the pair of chains, which are respectively formed at the support tapes, to or from each other.

FIGS. 1 and 2 are views for describing use states of a conventional zipper fastener.

Referring to FIGS. 1 and 2, an upper plate 1, a lower plate 2, and a guide post 3 are integrally formed in a conventional zipper fastener 10.

Also, a head 4 configured to be coupled to a pull tab 5 is formed at an upper portion of the upper plate 1. A deviation preventing flange 8 is formed downward at both sides of the upper plate 1. A chain accommodation 7 is formed between each deviation preventing flange 8 and the guide post 3.

A support tape accommodation 6 is formed between each deviation preventing flange 8 and the lower plate 2.

In this case, as illustrated in FIG. 1, when the zipper fastener 10 holds support tapes T using the support tape accommodations 6, chains C respectively formed at the support tapes T are inserted into the chain accommodations 7 formed in the zipper fastener 10.

The chains C inserted into the chain accommodations 7 are prevented from deviating to both sides by the deviation preventing flanges 8 formed at both sides of the upper plate 1.

When the zipper fastener 10 holding the support tapes T moves in a fixing direction, the chains C are coupled to each other such that a zipper G is closed. When the zipper fastener 10 moves in the opposite direction, the chains C are separated from each other such that the zipper G is opened.

Also, as illustrated in FIG. 2, in order to prevent a case where the zipper fastener 10 holding the support tapes T that is formed at a piece of clothing (not illustrated) continuously moves in the fixing direction or the opposite direction such that the support tapes T deviate from the support tape accommodations 6, stopping member 9 are formed at upper and lower portions of each support tape T.

In this way, in producing a piece of clothing, the support tapes T formed at an opening are held in the zipper fastener 10, and then the upper and lower portions of each support tape are finished with the stopping member. The conventional zipper fastener 10 in which the upper plate 1, the lower plate 2, and the guide post 3 are integrally formed is used as a pair with the zipper G in which the upper and lower portions of each support tape T are finished.

Meanwhile, regarding the zipper fastener used in the process of putting on or taking off a piece of clothing, a user continuously moves the zipper fastener in the fixing direction or the opposite direction using the pull tab 5 while gripping the pull tab 5 with his or her fingers such that the chains C are coupled to or separated from each other.

In this case, since the pull tab 5 is used while being fastened to the head 4 in the conventional zipper fastener, the pull tab 5 has a structure that is not separable from the head 4.

Therefore, the pull tab 5 is only used as a means for moving the zipper fastener.

Meanwhile, the pull tab 5 may be configured in various forms. If the pull tab 5 is separable from the head 4, the pull tab 5 would be replaceable, and thus, pull tabs of various forms would be applicable to the zipper fastener according to the user's moods. However, at this time, such a zipper fastener in which a pull tab is replaceable has not been developed at all.

Technical Problem

The present invention is directed to providing a zipper fastener in which a pull tab is separable from a head such that the pull tab is replaceable.

Also, the present invention is directed to providing a zipper fastener to which pull tabs or pull bodies of various forms are applicable according to the user's moods.

Objectives of the present invention are not limited to those mentioned above, and other unmentioned objectives should be clearly understood by those of ordinary skill in the art from the description below.

TECHNICAL SOLUTION

To solve the problem pointed out above, the present invention provides a zipper fastener including: an upper plate; a lower plate disposed to correspond to the upper plate; a head disposed in a predetermined region of an upper surface of the upper plate; and a pull body configured to be fastened to the head, wherein: the head includes a body portion and a flange portion extending to one side end of the body portion; the pull body includes a main body portion; the main body portion includes a main body portion lower surface disposed at a lower portion of the main body portion, a main body portion first side surface disposed at a first side of the main body portion, and a main body portion second side surface disposed at a second side of the main body portion and disposed to face the main body portion first side surface; the main body portion includes a head accommodation formed in a direction toward an inside of the main body portion from the main body portion lower surface; and the head accommodation includes a body portion accommodation configured to hold the body portion of the head and a flange portion accommodation configured to hold the flange portion of the head.

The main body portion may include a fastening groove extending in a direction toward the main body portion second side surface from the main body portion first side surface or extending in a direction toward the main body portion first side surface from the main body portion second side surface.

The zipper fastener may further include a fastening bar configured to be inserted into the fastening groove of the pull body.

The upper plate may include a first base plate, and the main body portion lower surface may come into contact with an upper surface of the first base plate of the upper plate.

The fastening groove may include a region overlapping with the body portion accommodation, and a depth of the body portion accommodation may be formed to be deeper than a depth of the fastening groove.

The present invention provides a pull body of a zipper fastener, the pull body including a main body portion, wherein: the main body portion includes a main body portion lower surface disposed at a lower portion of the main body portion, a main body portion first side surface disposed at a first side of the main body portion, and a main body portion second side surface disposed at a second side of the main body portion and disposed to face the main body portion first side surface; the main body portion includes a head accommodation formed in a direction toward an inside of the main body portion from the main body portion lower surface; and the main body portion includes a fastening groove extending in a direction toward the main body portion second side surface from the main body portion first side surface or extending in a direction toward the main body portion first side surface from the main body portion second side surface.

A head of the zipper fastener may include a body portion and a flange portion extending to one side end of the body portion, and the head accommodation may include a body portion accommodation configured to hold the body portion of the head and a flange portion accommodation configured to hold the flange portion of the head.

The fastening groove may include a region overlapping with the body portion accommodation, and a depth of the body portion accommodation may be formed to be deeper than a depth of the fastening groove.

Advantageous Effects

According to the present invention, since the head is separable from the upper plate, a pull tab is replaceable. Therefore, pull tabs or pull bodies of various forms are applicable to a zipper fastener according to a user's moods or needs.

DETAILED DESCRIPTION

Figure 1:
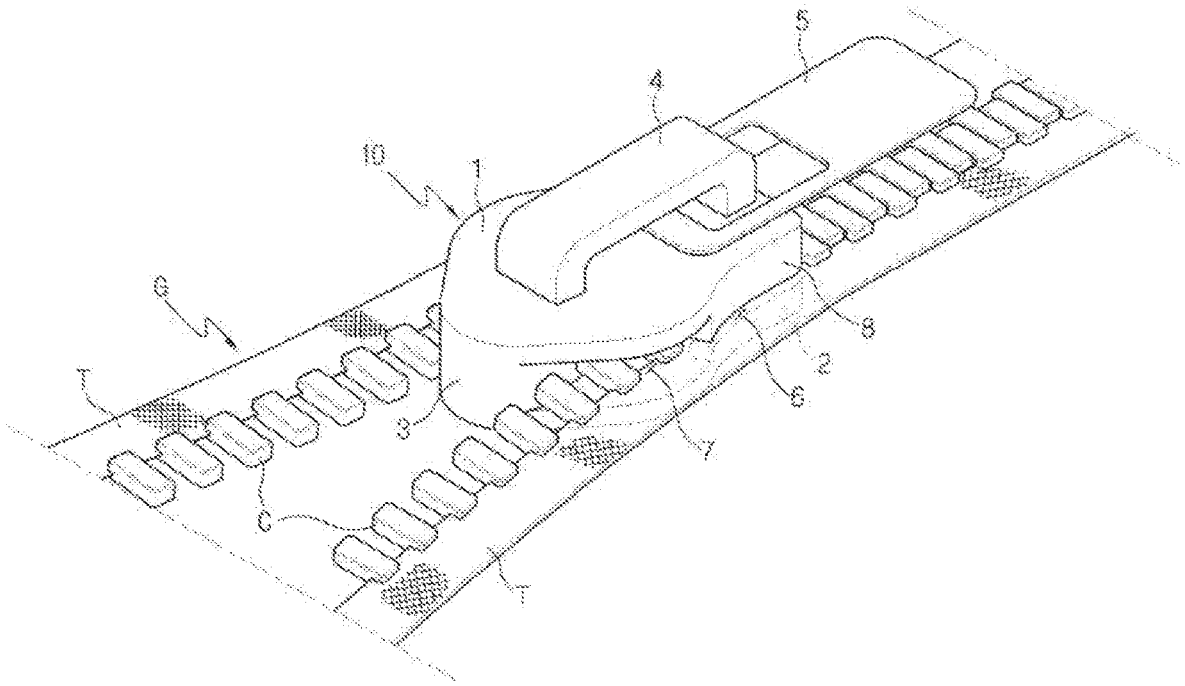
FIGS. 1 and 2 are views for describing use states of a conventional zipper fastener.
Figure 2:
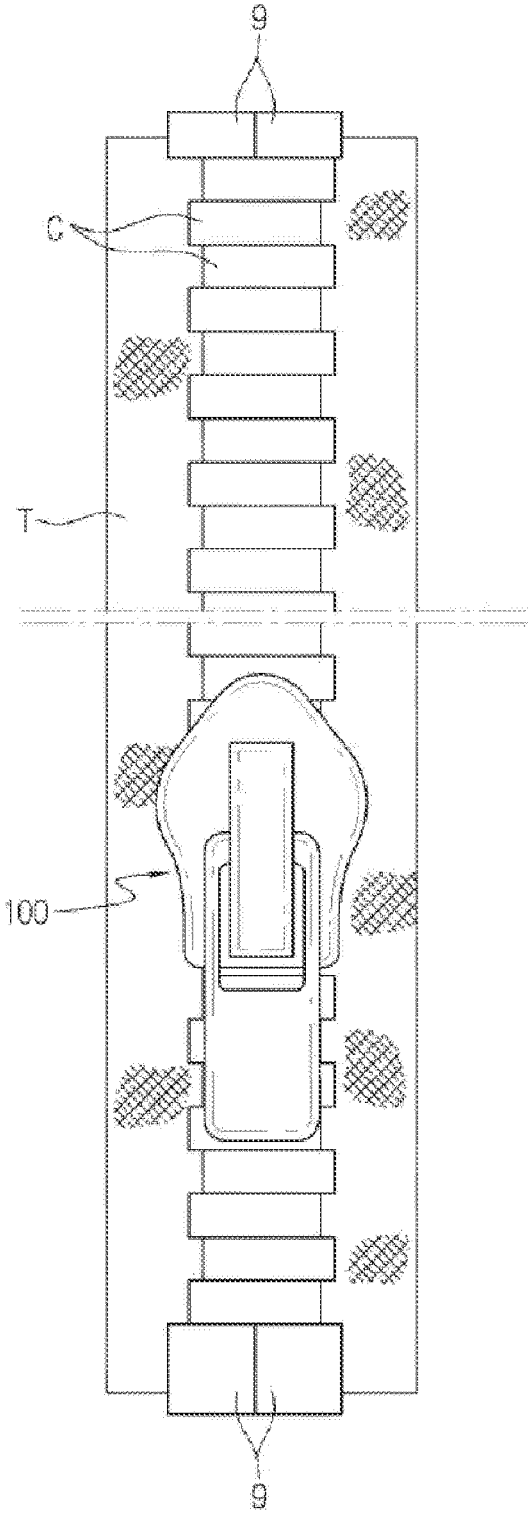

Advantages and features of the present invention and a method of achieving the same should become clear with embodiments described in detail below with reference to the accompanying drawings. However, the present invention is not limited to embodiments disclosed below and is realized in various other forms. The present embodiments make the disclosure of the present invention complete and are provided to completely inform those of ordinary skill in the art to which the present invention pertains of the scope of the invention. The present invention is defined only by the scope of the claims.

Details for practicing the present invention will be described below with reference to the accompanying drawings Like reference numerals refer to the same elements regardless of the drawings. The term "and/or" includes each mentioned item and all combinations of one or more of the items.

Ordinals such as first and second may be used to describe various elements, but of course the elements are not limited by the terms. The terms are only used for the purpose of distinguishing one element from another element. Therefore, a first element mentioned below may also be a second element within the technical idea of the present invention.

Terms used herein are for describing the embodiments and are not intended to limit the present invention. In the specification, a singular expression includes a plural expression unless the context clearly indicates otherwise. "Comprises" and/or "comprising" used herein do not preclude the existence or the possibility of adding one or more elements other than those mentioned.

Hereinafter, exemplary embodiments of the present invention will be described in detail with reference to the accompanying drawings.

Figure 3:
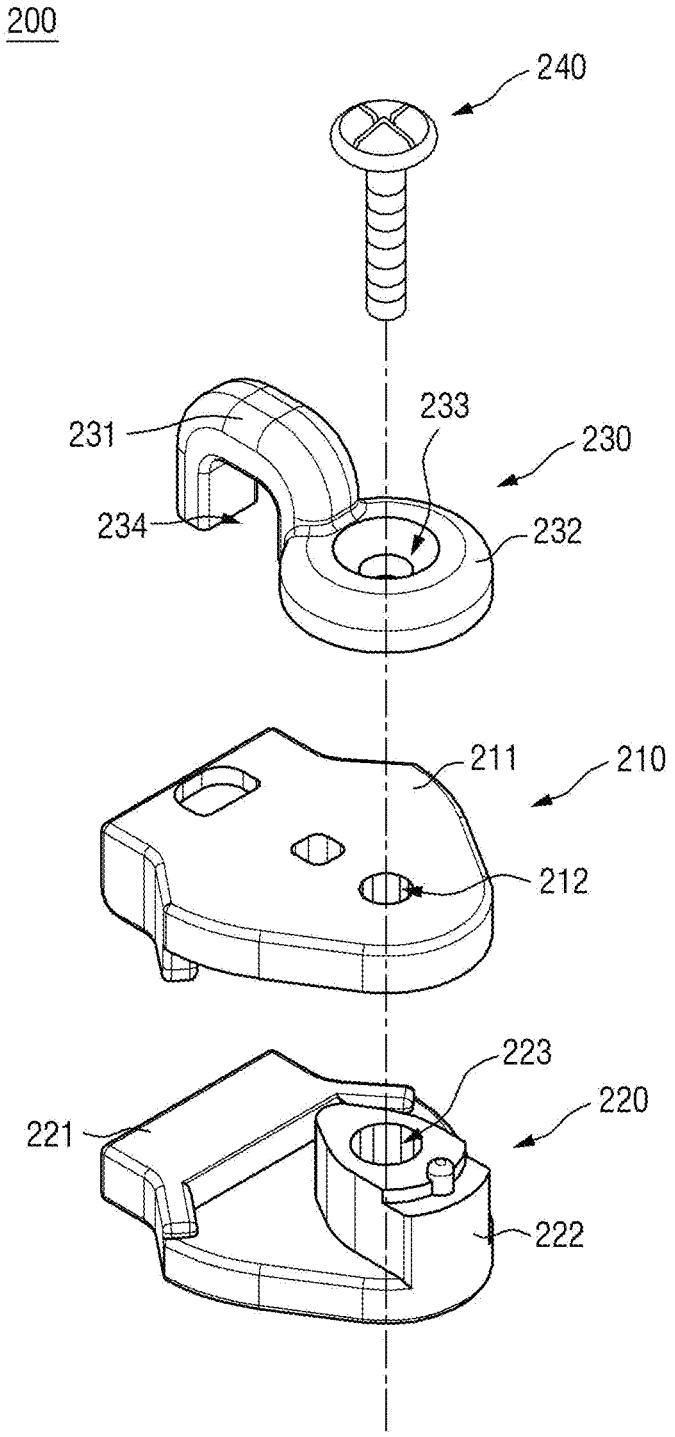
FIG. 3 is an exploded perspective view illustrating a zipper fastener according to a first embodiment of the present invention.
Figure 4:
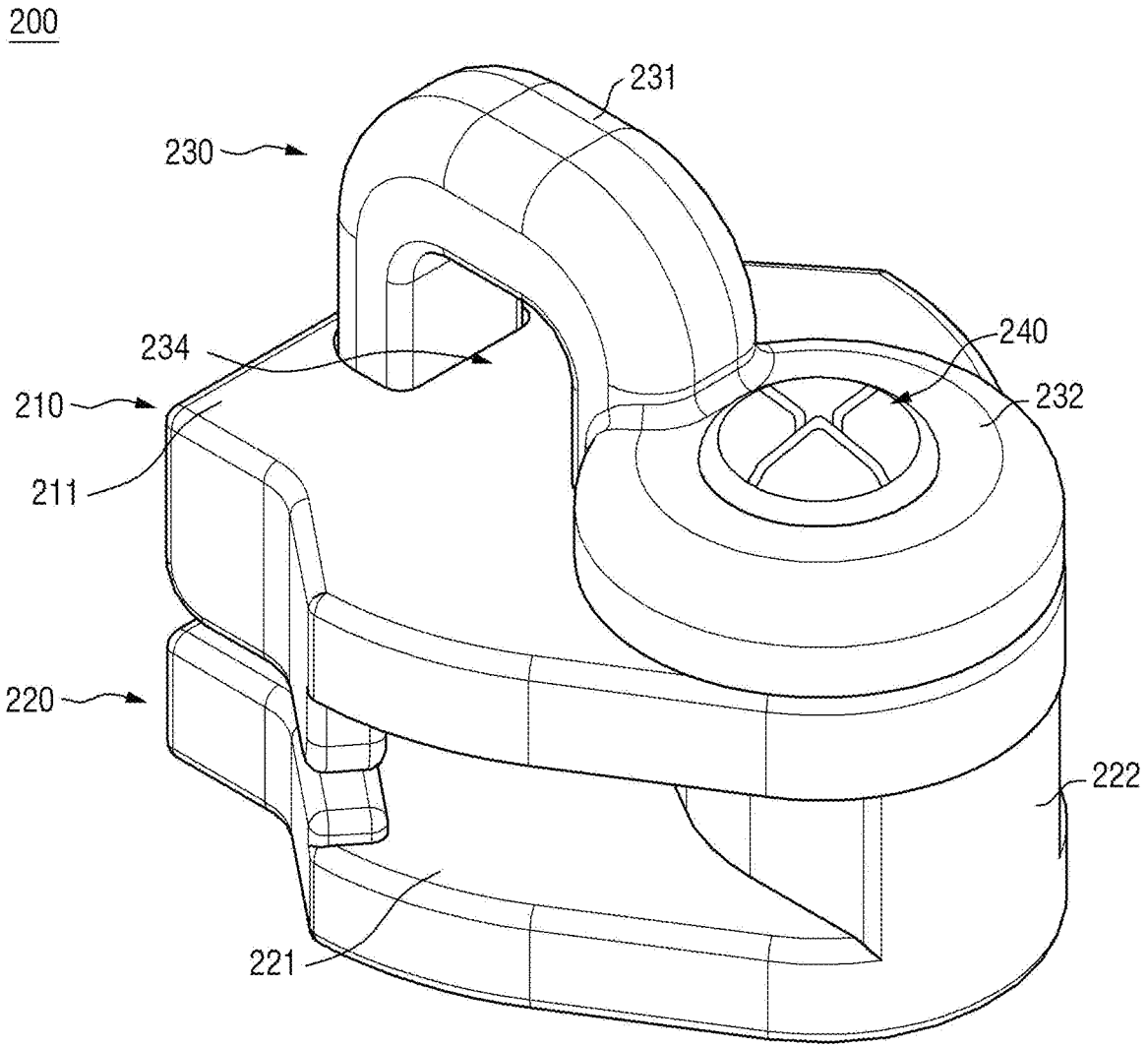
FIG. 4 is a coupled perspective view illustrating the zipper fastener according to the first embodiment of the present invention.

FIG. 3 is an exploded perspective view illustrating a zipper fastener according to a first embodiment of the present invention, and FIG. 4 is a coupled perspective view illustrating the zipper fastener according to the first embodiment of the present invention.

Referring to FIGS. 3 and 4, a zipper fastener 200 according to the first embodiment of the present invention includes an upper plate 210 and a lower plate 220 disposed to correspond to the upper plate 210 and includes a head 230 which is disposed in a predetermined region of an upper surface of the upper plate 210 and separable from the upper plate.

In this case, the upper plate 210 includes a first base plate 211, and the head 230 may be disposed in a predetermined region of an upper surface of the first base plate 211.

Also, the first base plate 211 includes a first fastening hole 212.

Next, referring to FIGS. 3 and 4, the lower plate 220 includes a second base plate 221 and includes a guide post 222 disposed in front of the second base plate 221. Also, the guide post 222 includes a second fastening hole 223 disposed in a region corresponding to the first fastening hole 212.

In this case, in the present invention, the upper plate 210 and the lower plate 220 may be separable from each other. The upper plate and the lower plate may be fastened to each other through a fastening means 240 which will be described below, or, when the fastening means 240 is removed, the upper plate 210 and the lower plate 220 may be separated from each other.

Next, referring to FIGS. 3 and 4, the zipper fastener 200 according to the first embodiment of the present invention includes the head 230 which is disposed in the predetermined region of the upper surface of the upper plate 210 and separable from the upper plate.

In this case, as described above, the head 230 may be disposed in the predetermined region of the upper surface of the first base plate 211.

Meanwhile, in the present invention, the head 230 is separable from the upper plate. More specifically, the head 230 includes a body portion 231, which includes a pull tab accommodation 234, and a flange portion 232 extending to one side end of the body portion 231.

Also, the head 230 includes a third fastening hole 233 which is disposed in a predetermined region of the flange portion 232 and disposed in a region corresponding to the first fastening hole 212.

Also, the zipper fastener 200 according to the first embodiment of the present invention includes the fastening means 240 configured to be fastened by being inserted into the first fastening hole 212 and the third fastening hole 233. The upper plate 210 and the head 230 may be fastened to each other as the fastening means 240 is coupled to the first fastening hole 212 and the third fastening hole 233, and the upper plate 210 and the head 230 may be separated from each other as the fastening means 240 is separated from the first fastening hole 212 and the third fastening hole 233.

In this case, a known coupling means such as a screw or bolt may be used as the fastening means 240, but the type of fastening means 240 is not limited in the present invention.

Also, as illustrated in the drawings, the fastening means 240 may be inserted into the second fastening hole 223 at the same time as being inserted into the first fastening hole 212 and the third fastening hole 233. As the fastening means 240 is coupled to the first fastening hole 212, the third fastening hole 233, and the second fastening hole 223, the upper plate 210 and the head 230 may be fastened to each other, and the upper plate 210 and the lower plate 220 may be fastened to each other.

Also, as the fastening means 240 is separated from the first fastening hole 212, the third fastening hole 233, and the second fastening hole 223, the upper plate 210 and the head 230 may be separated from each other, and the upper plate 210 and the lower plate 220 may be separated from each other.

Meanwhile, although not illustrated in the drawings, a pull tab (not illustrated) may be disposed in the pull tab accommodation 234 configured in the body portion 231 of the head 230. Since this is a known art, detailed description thereof will be omitted.

As described above, a user continuously moves the zipper fastener in a fixing direction or the opposite direction using the pull tab while gripping the pull tab with his or her fingers such that the chains are coupled to or separated from each other.

In this case, since the pull tab is used while being fastened to the head in a conventional zipper fastener, the pull tab has a structure that is not separable from the head 4.

Therefore, the pull tab is only used as a means for moving the zipper fastener.

However, in the present invention, as described above, the head 230 is separable from the upper plate 210, and thus, the pull tab may be easily replaced while the head 230 is separated from the upper plate 210.

That is, in the present invention, since the pull tab is replaceable, pull tabs of various forms are applicable to the zipper fastener according to the user's moods or needs.

Figure 12:
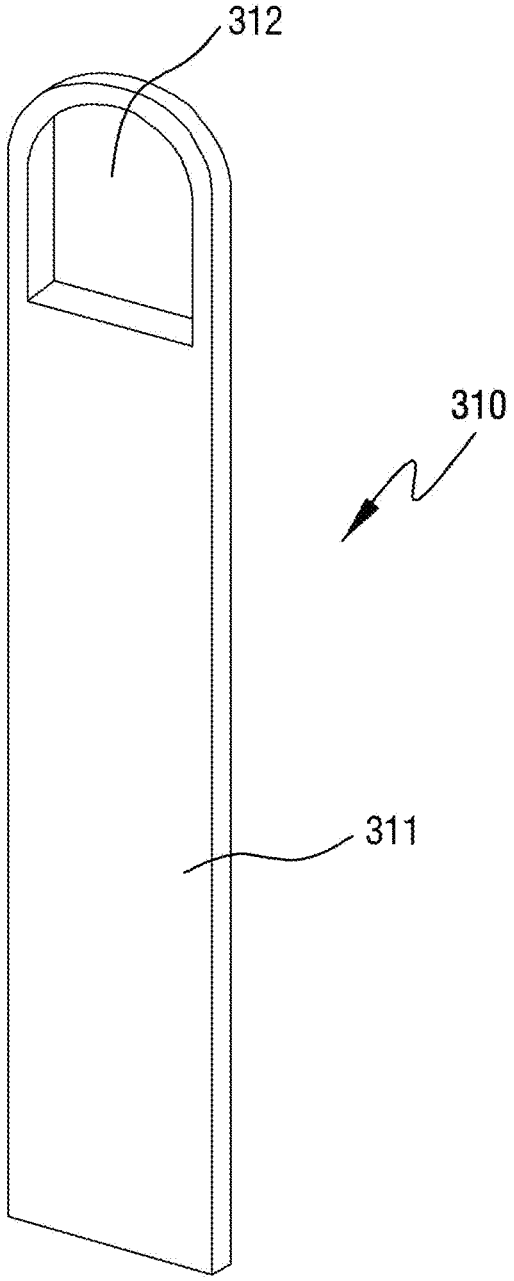
FIGS. 12 to 14 are schematic views illustrating pull tabs of various forms.
Figure 13:
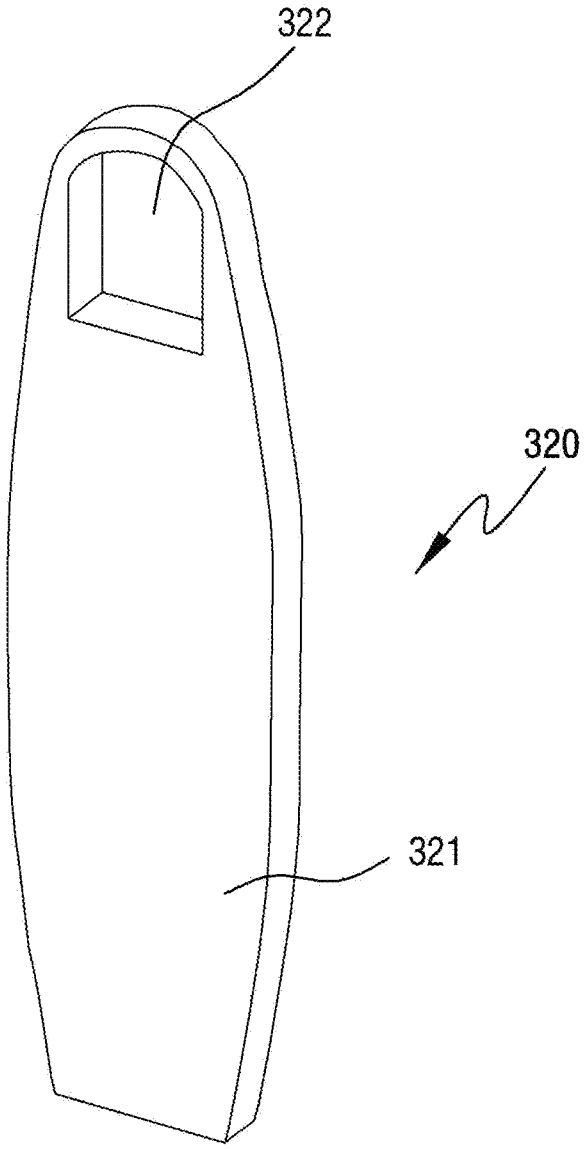
Figure 14:
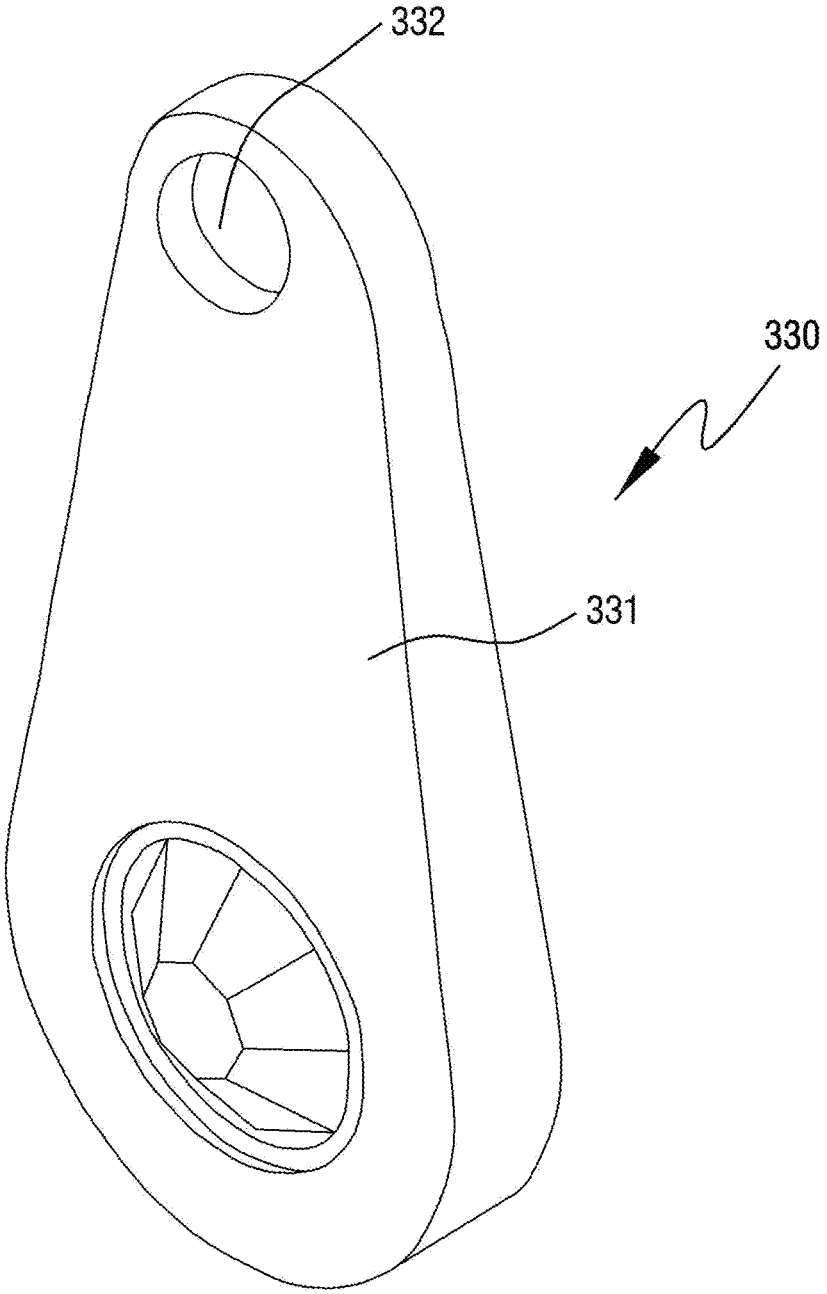

FIGS. 12 to 14 are schematic views illustrating pull tabs of various forms.

Referring to FIG. 12, a pull tab 310 according to a first example includes a first handle portion 311 and a first annular portion 312 disposed in an end region of the first handle portion 311. In this case, the first annular portion 312 may be disposed in the pull tab accommodation 234 configured in the body portion 231 of the head 230 of FIGS. 3 and 4.

Also, referring to FIG. 13, a pull tab 320 according to a second example includes a second handle portion 321 and a second annular portion 322 disposed in an end region of the second handle portion 321. Also, referring to FIG. 14, a pull tab 330 according to a third example may include a third handle portion 331 and a third annular portion 332 disposed in an end region of the third handle portion 331.

That is, in the present invention, such pull tabs 310, 320, and 330 of various forms may be easily replaced with one another according to the user's moods or needs.

The zipper fastener according to the first embodiment of the present invention will be described in further detail below.

Figure 5:
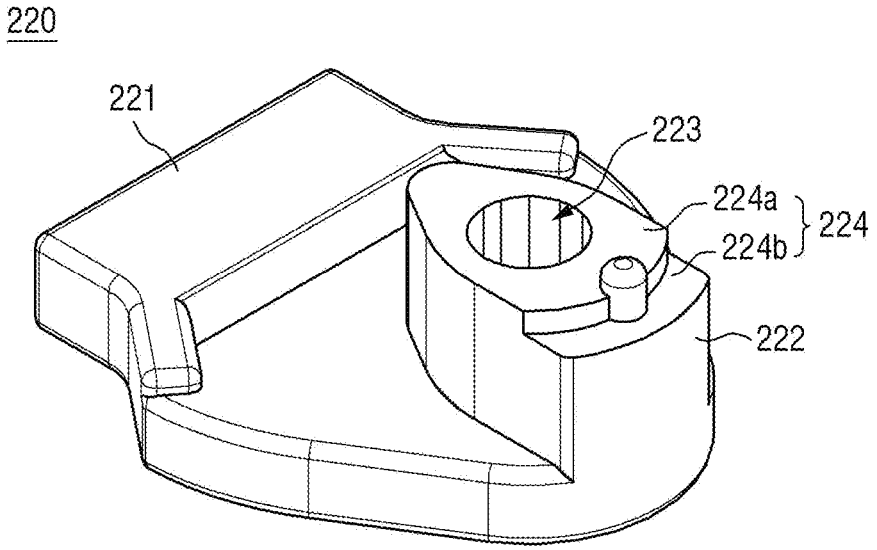
FIG. 5 is a perspective view illustrating a lower plate of the zipper fastener according to the first embodiment of the present invention.
Figure 6:
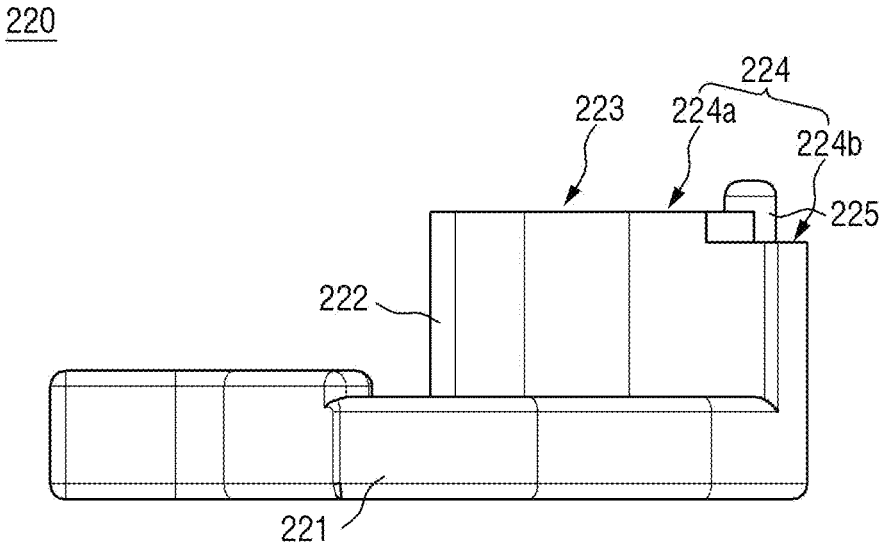
FIG. 6 is a side view illustrating the lower plate of the zipper fastener according to the first embodiment of the present invention.
Figure 7:
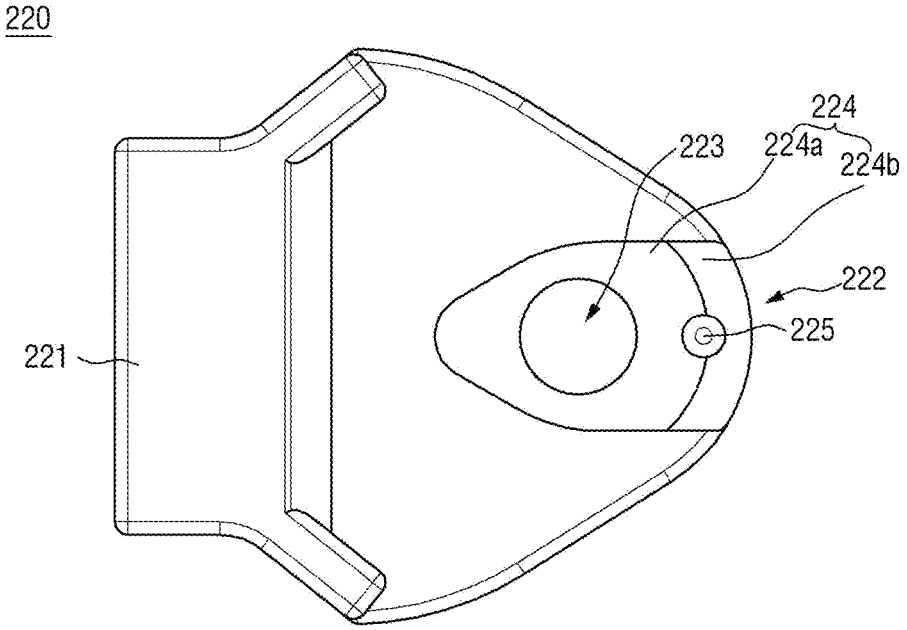
FIG. 7 is a plan view illustrating the lower plate of the zipper fastener according to the first embodiment of the present invention.

FIG. 5 is a perspective view illustrating a lower plate of the zipper fastener according to the first embodiment of the present invention, FIG. 6 is a side view illustrating the lower plate of the zipper fastener according to the first embodiment of the present invention, and FIG. 7 is a plan view illustrating the lower plate of the zipper fastener according to the first embodiment of the present invention.

Referring to FIGS. 5 to 7, as described above, the lower plate 220 of the zipper fastener according to the first embodiment of the present invention includes the second base plate 221 and includes the guide post 222 disposed in front of the second base plate 221. Also, the guide post 222 includes the second fastening hole 223 disposed in the region corresponding to the first fastening hole 212.

In this case, the guide post 222 includes a guide post upper surface 224. The guide post upper surface 224 includes a first upper surface 224*a* in which the second fastening hole 223 is disposed and a second upper surface 224*b* which is disposed at an outer side end of the guide post 222 and has a step height lower than that of the first upper surface 224*a*.

Also, the guide post 222 includes a protrusion 225 disposed in a predetermined region of the guide post upper surface 224.

The coupling relationship between the guide post upper surface 224 including the first upper surface 224*a* and second upper surface 224*b* and the upper plate of the zipper fastener described above and the coupling relationship between the protrusion 225 and the upper plate of the zipper fastener described above will be described below.

Figure 8:
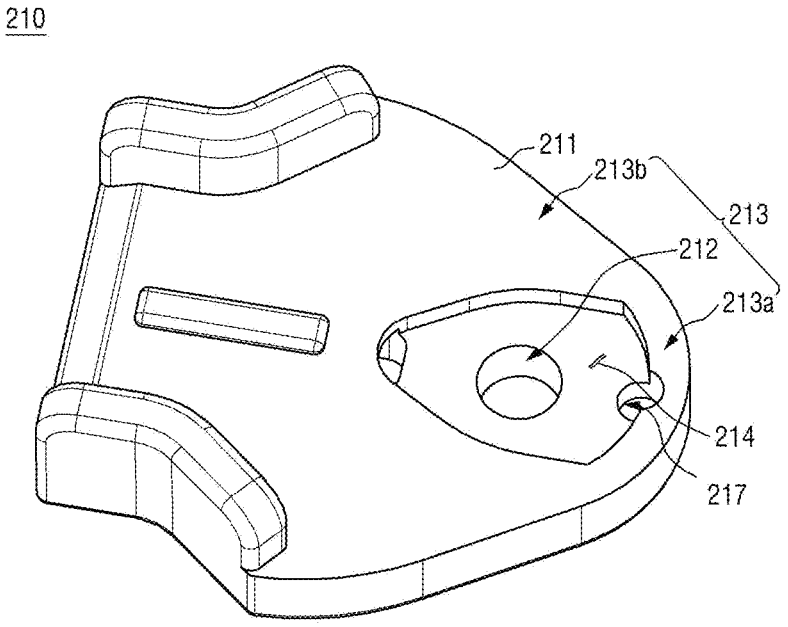
FIG. 8 is a perspective view in a first direction that illustrates an upper plate of the zipper fastener according to the first embodiment of the present invention.
Figure 9:
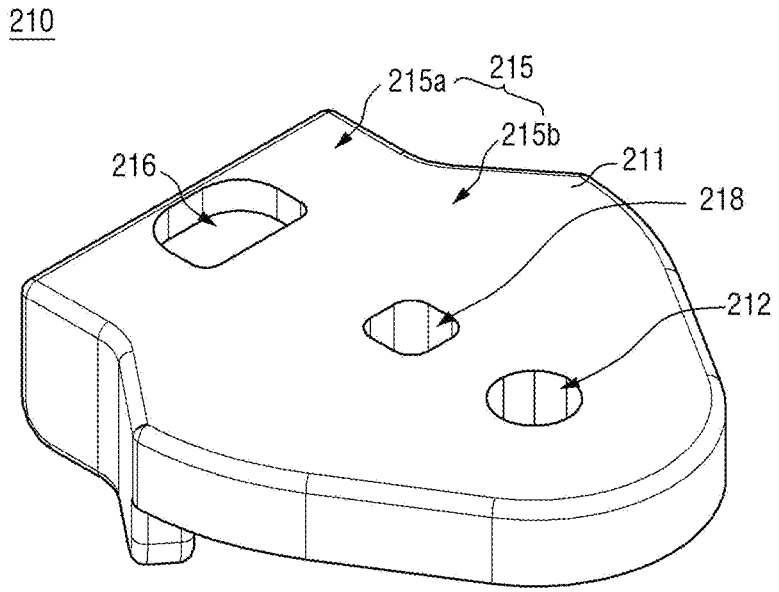
FIG. 9 is a perspective view in a second direction that illustrates the upper plate of the zipper fastener according to the first embodiment of the present invention.

FIG. 8 is a perspective view in a first direction that illustrates an upper plate of the zipper fastener according to the first embodiment of the present invention, and FIG. 9 is a perspective view in a second direction that illustrates the upper plate of the zipper fastener according to the first embodiment of the present invention.

In this case, the first direction may refer to a direction toward a lower surface of the upper plate, and the second direction may refer to a direction toward the upper surface of the upper plate.

Referring to FIGS. 8 and 9, as described above, the upper plate 210 of the zipper fastener according to the first embodiment of the present invention includes the first base plate 211 and includes the first fastening hole 212 disposed in a predetermined region of the first base plate 211.

Also, referring to FIG. 8, the upper plate 210 includes a lower surface 213 of the first base plate 211, and the lower surface 213 of the first base plate 211 includes a first base plate first lower surface 213*a* disposed at one side end of the first base plate and a first base plate second lower surface 213*b* which is a region excluding the first base plate first lower surface.

Also, the lower surface 213 of the first base plate 211 may include an holding groove 214, which is disposed in a predetermined region of the lower surface 213 of the first base plate 211 and has a step height lower than that of the first base plate first lower surface 213*a*, and include the first fastening hole 212 may be included in a predetermined region of the holding groove 214.

Also, the lower surface 213 of the first base plate 211 includes a first groove portion 217 which is disposed across the first base plate first lower surface 213*a* and the holding groove 214 and has a step height lower than that of the holding groove 214.

In this case, the first base plate first lower surface 213*a* corresponds to a surface coming into contact with the second upper surface 224*b* of the guide post upper surface 224 of the lower plate 220 of FIGS. 5 to 7 described above.

That is, the upper plate 210 and the lower plate 220 may be fastened to each other while the first base plate first lower surface 213*a* is in contact with the second upper surface 224*b* of the guide post upper surface 224.

Also, the holding groove 214 corresponds to a groove holding the first upper surface 224*a* of the guide post upper surface 224 of the lower plate 220 of FIGS. 5 to 7 described above.

That is, in the present invention, since the upper plate 210 and the lower plate 220 are fastened to each other while the first upper surface 224*a* of the guide post upper surface 224 of the lower plate 220 is held in the holding groove 214, the upper plate 210 and the lower plate 220 may be more firmly coupled to each other.

Also, the first groove portion 217 corresponds to a groove holding the protrusion 225 of the lower plate 220 of FIGS. 5 to 7 described above.

That is, the upper plate 210 and the lower plate 220 may be fastened to each other while the protrusion 225 of the lower plate 220 is held in the first groove portion 217.

In this case, in fastening the upper plate 210 and the lower plate 220 to each other, the protrusion 225 may serve as a reference point of fastening between the upper plate 210 and the lower plate 220 by being held in the first groove portion 217.

Also, referring to FIG. 9, the upper plate 210 includes an upper surface 215 of the first base plate 211, and the upper surface 215 of the first base plate 211 includes a first base plate first upper surface 215*a* disposed at the other side end of the first base plate and a first base plate second upper surface 215*b* which is a region excluding the first base plate first upper surface.

Also, the upper surface 215 of the first base plate 211 may include a support groove 216 disposed in a predetermined region of the first base plate first upper surface 215*a* of the upper surface 215 of the first base plate 211.

Also, the upper surface 215 of the first base plate 211 may include a second groove portion 218 disposed between the support groove 216 and the first fastening hole 212.

The coupling relationship between the support groove 216 disposed in a predetermined region of the first base plate first upper surface 215*a* and the head of the zipper fastener described above and the coupling relationship between the second groove portion 218 disposed between the support groove 216 and the first fastening hole 212 and the head of the zipper fastener described above will be described below.

Figure 10:
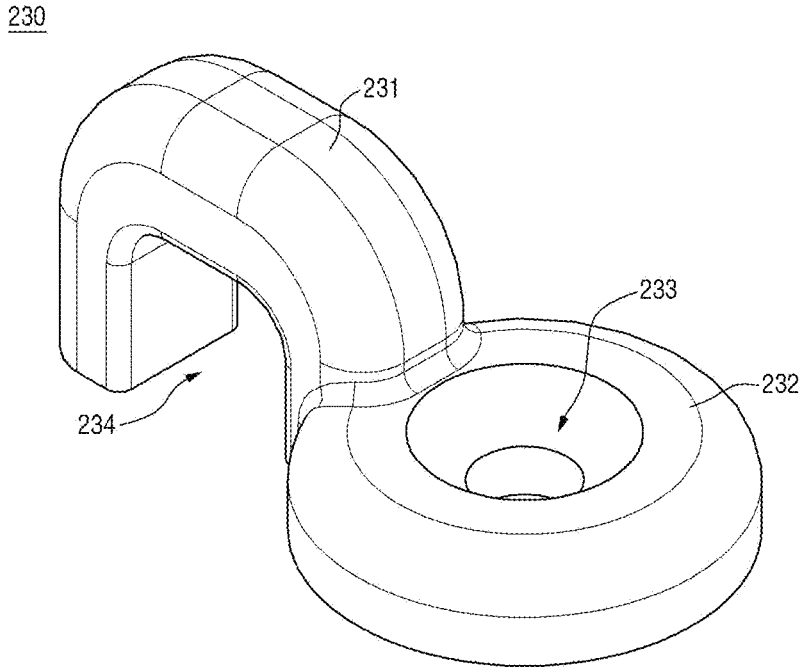
FIG. 10 is a perspective view illustrating a head of the zipper fastener according to the first embodiment of the present invention.
Figure 11:
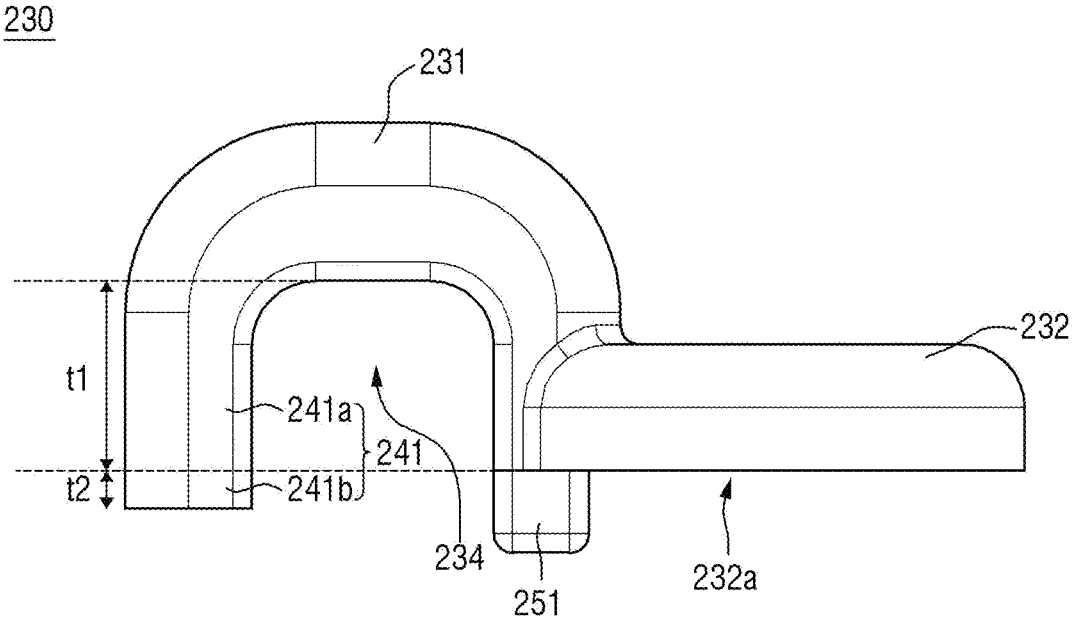
FIG. 11 is a side view illustrating the head of the zipper fastener according to the first embodiment of the present invention.

FIG. 10 is a perspective view illustrating a head of the zipper fastener according to the first embodiment of the present invention, and FIG. 11 is a side view illustrating the head of the zipper fastener according to the first embodiment of the present invention.

Referring to FIGS. 10 and 11, as described above, the head 230 of the zipper fastener according to the first embodiment of the present invention includes the body portion 231 including the pull tab accommodation 234 and the flange portion 232 extending to one side end of the body portion 231, and the head 230 includes the third fastening hole 233 which is disposed in the predetermined region of the flange portion 232 and disposed in the region corresponding to the first fastening hole 212.

In this case, referring to FIG. 11, the flange portion 232 of the head 230 of the zipper fastener according to the first embodiment of the present invention includes a flange portion lower surface 232*a*. The upper plate 210 and the head 230 may be fastened to each other while the flange portion lower surface 232*a* is in contact with the upper surface 215 of the first base plate 211 of the upper plate 210.

Also, referring to FIG. 11, the body portion 231 of the head 230 may have a semi-annular shape. The pull tab accommodation 234 may be formed due to the semi-annular shape.

In this case, the flange portion 232 may extend from one side region of the semi-annular shape. The flange portion may extend in a first direction, e.g., a horizontal direction, from the one side region of the semi-annular shape.

Also, the head 230 may include a protrusion 251 extending in a second direction, e.g., a vertical direction, from the one side region of the semi-annular shape of the body portion 231.

Meanwhile, the other side region of the semi-annular shape includes a support body 241 having a linear shape.

The support body 241 includes a first support body 241*a* having a first length t1 and a second support body 241*b* having a second length t2 that extends from the first support body 241*a*.

In this case, as illustrated in the drawings, the support body 241 protrudes more than the flange portion lower surface 232*a* by the second length t2 of the second support body 241*b*.

Next, referring to FIGS. 10 and 11, as described above, the upper plate 210 and the head 230 may be fastened to each other while the flange portion lower surface 232*a* is in contact with the upper surface 215 of the first base plate 211 of the upper plate 210 of FIGS. 8 and 9 described above.

In this case, in fastening the upper plate 210 and the head 230 to each other, the support body 241 is inserted into the support groove 216 disposed in the predetermined region of the first base plate first upper surface 215*a*. More specifically, the second support body 241*b* of the support body 241 is inserted into the support groove 216.

That is, since the head and the upper plate are fastened to each other while the second support body 241*b* of the support body 241 is inserted into the support groove 216 in the zipper fastener 200 according to the first embodiment of the present invention, the head may be prevented from being unintentionally rotated from the upper plate.

More specifically, in the present invention, in fastening the head 230 to the upper plate 210 through the fastening means 240, the fastening is performed in a single region. When the fastening is performed is a single region, the head may be unintentionally rotated from the upper plate.

Therefore, in the present invention, by fastening the head and the upper plate to each other while the second support body 241*b* of the support body 241 is inserted into the support groove 216, the head may be prevented from being unintentionally rotated from the upper plate.

Also, the head 230 includes the protrusion 251 extending in the second direction, e.g., the vertical direction, from the one side region of the semi-annular shape of the body portion 231. The upper plate 210 and the head 230 may be fastened to each other while the protrusion 251 is inserted into the second groove portion 218 disposed between the support groove 216 and the first fastening hole 212 of the upper plate of FIGS. 8 and 9 described above.

By being inserted into the second groove portion 218, the protrusion 251 may not only prevent the unintentional rotation of the head from the upper plate like the second support body 241*b* described above, but also serve as a reference point of fastening between the upper plate 210 and the head 230 in fastening the head to the upper plate.

According to the present invention described above, since the head is separable from the upper plate in the present invention, the pull tab is replaceable, and thus, pull tabs of various forms are applicable to the zipper fastener according to the user's moods or needs.

Also, in the present invention, since the upper plate 210 and the lower plate 220 are fastened to each other while the first upper surface 224*a* of the guide post upper surface 224 of the lower plate 220 is held in the holding groove 214, the upper plate 210 and the lower plate 220 may be more firmly coupled to each other.

Also, in the present invention, since the head and the upper plate are fastened to each other while the second support body 241*b* of the support body 241 is inserted into the support groove 216, the head may be prevented from being unintentionally rotated from the upper plate.

Meanwhile, in the present invention, as described above, the pull tabs of various forms of FIGS. 12 to 14 described above may be fastened to the pull tab accommodation 234 of the head 230 described above.

That is, referring to FIG. 12, the pull tab 310 according to the first example includes the first handle portion 311 and the first annular portion 312 disposed in the end region of the first handle portion 311. In this case, the first annular portion 312 may be disposed in the pull tab accommodation 234 configured in the body portion 231 of the head 230 of FIGS. 3 and 4.

Also, referring to FIG. 13, the pull tab 320 according to the second example includes the second handle portion 321 and the second annular portion 322 disposed in the end region of the second handle portion 321. Also, referring to FIG. 14, the pull tab 330 according to the third example may include the third handle portion 331 and the third annular portion 332 disposed in the end region of the third handle portion 331.

Therefore, in the present invention, such pull tabs 310, 320, and 330 of various forms may be easily replaced with one another according to the user's moods or needs.

That is, in a general zipper fastener, the pull tabs of various forms of FIGS. 12 to 14 described above are fastened to the pull tab accommodation 234 of the head 230.

However, in the present invention, in addition to the above-described pull tabs of general forms, a pull tab of a new form developed by the present applicant is also attempted to be fastened. The pull tab of the new form according to the present invention and a structure for fastening the pull tab to the head of the zipper fastener will be described.

However, in order to distinguish the pull tab of the new form from the pull tabs of general forms of FIGS. 12 to 14, the pull tab of the new form according to the present invention will be referred to as a pull body, but the pull body according to the present invention may be understood as performing the same function as the pull tabs of general forms.

Figure 15:
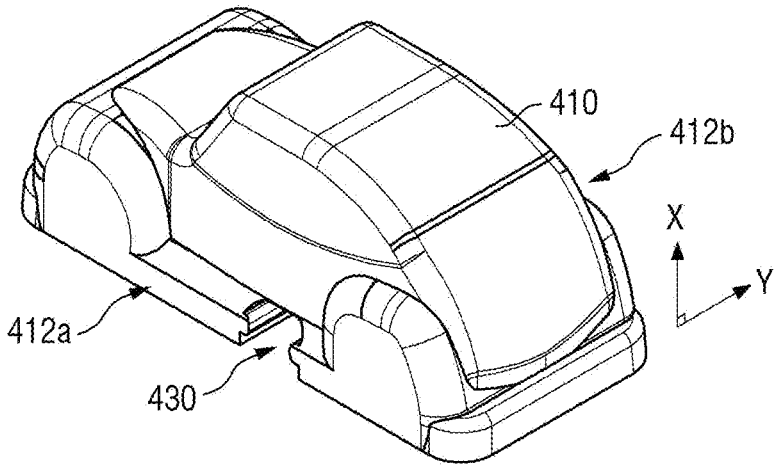
FIGS. 15 and 16 are perspective views illustrating a pull body of a zipper fastener according to the present invention.
Figure 16:
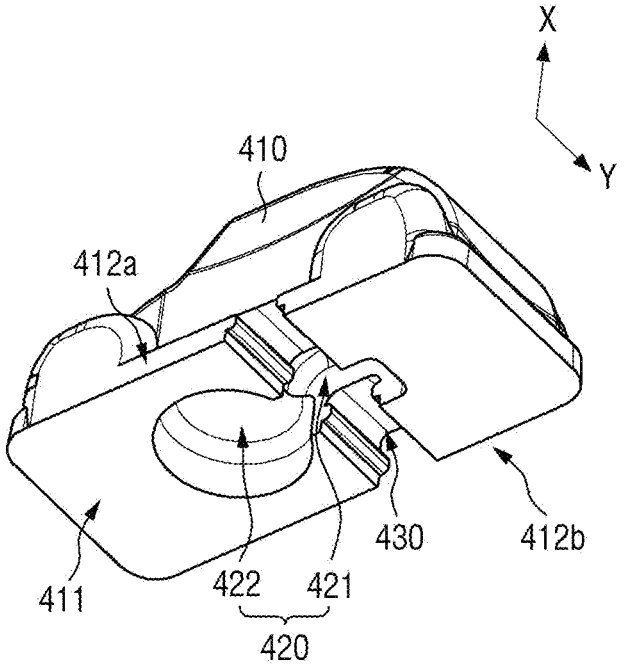
Figure 17:
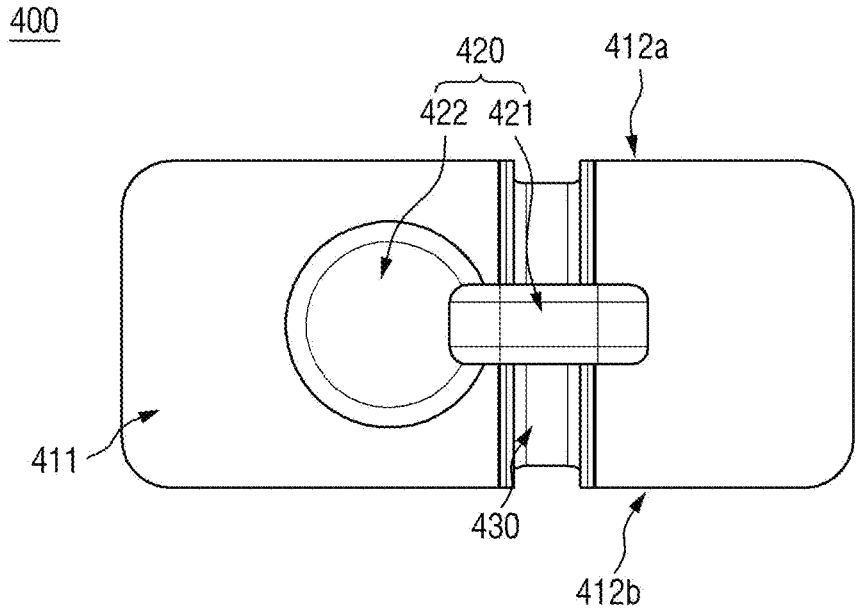
FIG. 17 is a bottom view illustrating the pull body of the zipper fastener according to the present invention.

FIGS. 15 and 16 are perspective views illustrating a pull body of a zipper fastener according to the present invention, and FIG. 17 is a bottom view illustrating the pull body of the zipper fastener according to the present invention.

Referring to FIGS. 15 to 17, a pull body 400 of a zipper fastener according to the present invention includes a main body portion 410.

In this case, the main body portion 410 according to the present invention may be configured in shapes of various characters. For example, the main body portion 410 may be configured in the shape of an automobile as illustrated in FIGS. 15 to 17.

However, in the present invention, the main body portion may be configured in shapes of various other characters, such as a train, a ship, an animal, or a doll, in addition to the shape of an automobile. Therefore, the shape of the main body portion is not limited in the present invention.

Figure 27:
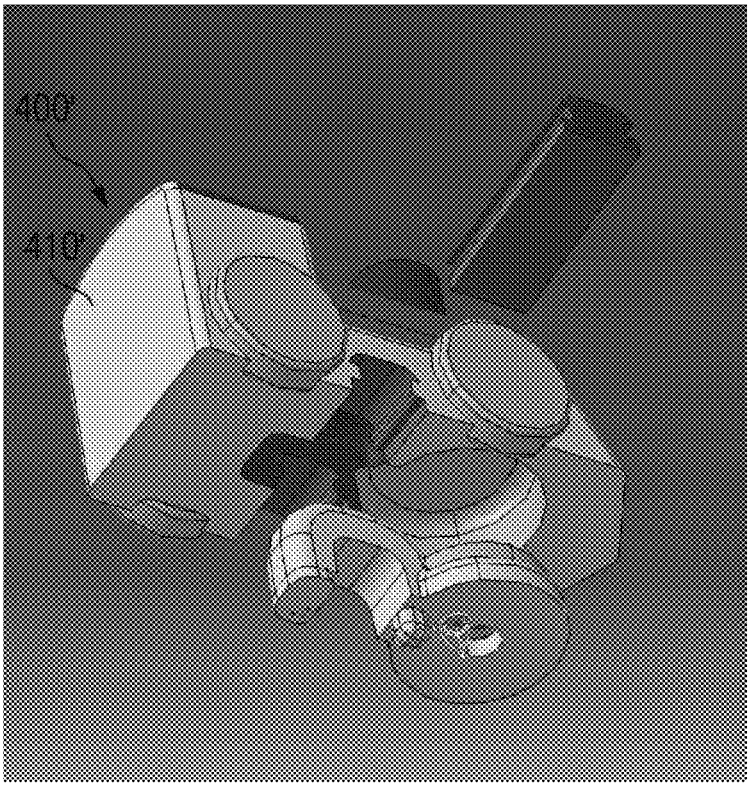
FIG. 27 is a view illustrating another form of a main body portion according to the present invention.

FIG. 27 is a view illustrating another form of the main body portion according to the present invention. As illustrated in FIG. 27, a main body portion 410' of a pull body 400' of a zipper fastener according to the present invention may be configured in the shape of a train.

Next, referring to FIGS. 15 to 17, the main body portion 410 includes a main body portion lower surface 411 disposed at a lower portion of the main body portion 410. In this case, the main body portion lower surface 411 comes into contact with the upper surface of the first base plate 211 of the upper plate 210 of FIGS. 3 and 4 described above.

Therefore, when the upper surface of the first base plate 211 is flat, it is desirable that the main body portion lower surface 411 be flat so that the main body portion lower surface 411 may come into contact with the upper surface of the first base plate 211.

Also, the main body portion 410 includes a main body portion first side surface 412*a* disposed at a first side of the main body portion 410 and a main body portion second side surface 412*b* which is disposed at a second side of the main body portion 410 and disposed to face the main body portion first side surface 412*a*.

Next, referring to FIGS. 15 to 17, the main body portion 410 includes a head accommodation 420 formed in a direction toward an inside of the main body portion (an X-direction) from the main body portion lower surface 411, and the head accommodation 420 includes a body portion accommodation 421 configured to hold the body portion 231 of the head 230 of FIGS. 10 and 11 described above and a flange portion accommodation 422 configured to hold the flange portion 232 of the head 230.

Also, referring to FIGS. 15 to 17, the main body portion 410 includes a fastening groove 430 extending in a direction toward the main body portion second side surface 412*b* (a Y-direction) from the main body portion first side surface 412*a* or extending in a direction toward the main body portion first side surface 412*a* (a −Y-direction) from the main body portion second side surface 412*b*.

In this case, as illustrated in the drawings, the fastening groove 430 includes a region overlapping with the body portion accommodation 421, but a depth of the body portion accommodation 421 is formed to be deeper than a depth of the fastening groove 430.

The body portion 231 of the head 230 has a semi-annular shape, and the pull tab accommodation 234 is formed due to the semi-annular shape. Since the body portion 231 of the head should maintain the state of being held in the body portion accommodation 421, the depth of the body portion accommodation 421 is formed to be deeper than the depth of the fastening groove 430 so that the body portion 231 of the head may be disposed in the body portion accommodation 421.

That is, when the body portion 231 of the head is disposed in the body portion accommodation 421, the fastening groove 430 is disposed on the same plane as the pull tab accommodation 234 formed due to the semi-annular shape of the body portion 231. Therefore, in order to allow the body portion 231 of the head to be disposed in the body portion accommodation 421 while the fastening groove 430 is disposed on the same plane as the pull tab accommodation 234 formed due to the semi-annular shape of the body portion 231, the depth of the body portion accommodation 421 is formed to be deeper than the depth of the fastening groove 430.

This will be mentioned again below with reference to FIG. 20.

Figure 18:
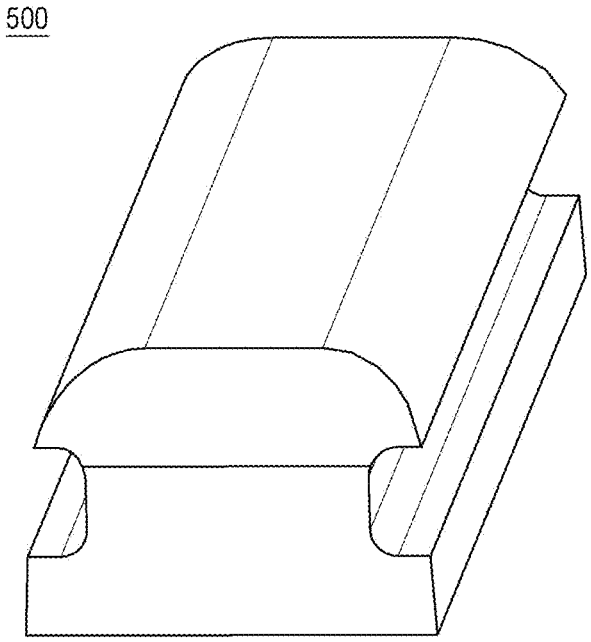
FIGS. 18 and 19 are perspective views illustrating a fastening bar according to the present invention.
Figure 19:
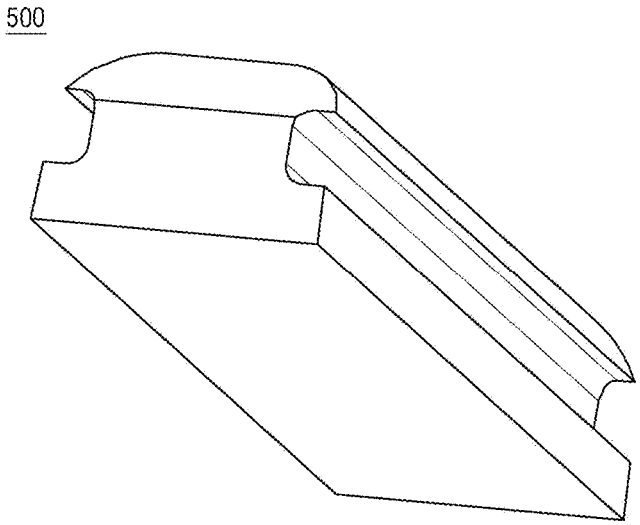

FIGS. 18 and 19 are perspective views illustrating a fastening bar according to the present invention.

Referring to FIGS. 18 and 19, a fastening bar 500 according to the present invention is inserted into the fastening groove 430 of the pull body 400 according to the present invention described above. Although the fastening bar 500 is illustrated in the drawings as having an H-shaped cross-section, the shape of the fastening bar 500 is not limited in the present invention. However, it is desirable that the fastening bar 500 according to the present invention have a bar shape so that the fastening bar 500 may be inserted into the fastening groove 430.

Figure 20:
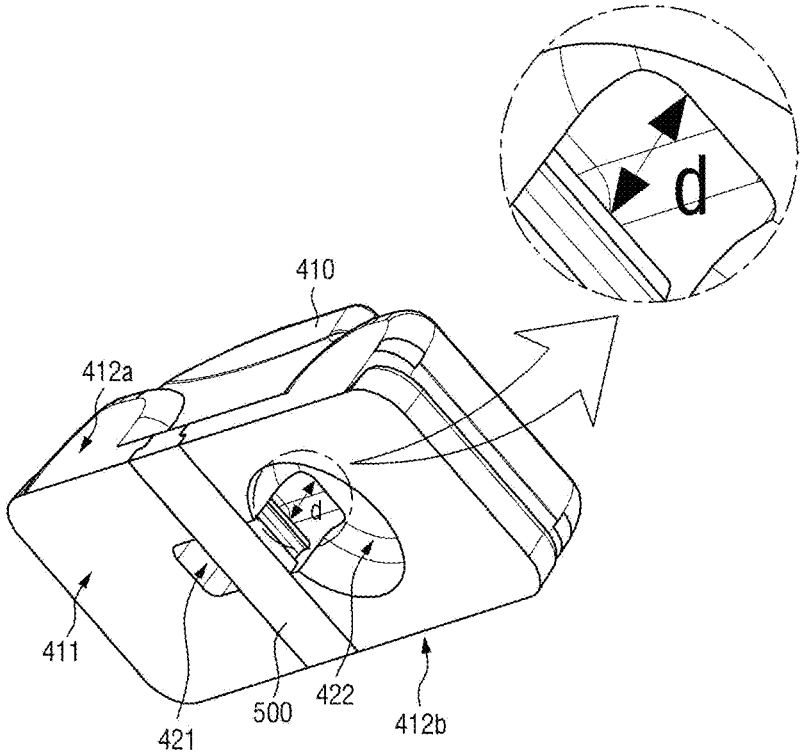
FIG. 20 is a perspective view illustrating a fastening state between the pull body and the fastening bar according to the present invention.

FIG. 20 is a perspective view illustrating a fastening state between the pull body and the fastening bar according to the present invention.

As described above, the main body portion 410 according to the present invention includes the fastening groove 430 extending in the direction toward the main body portion second side surface 412*b* (the Y-direction) from the main body portion first side surface 412*a* or extending in the direction toward the main body portion first side surface 412*a* (the −Y-direction) from the main body portion second side surface 412*b*, and the fastening bar 500 is inserted into the fastening groove 430.

In this case, it can be confirmed that, as illustrated in FIG. 20, the depth of the body portion accommodation 421 is formed to be deeper than the depth of the fastening groove 430 (by a difference indicated by "d").

Hereinafter, a zipper fastener to which the fastening bar according to the present invention is fastened will be described.

Figure 21:
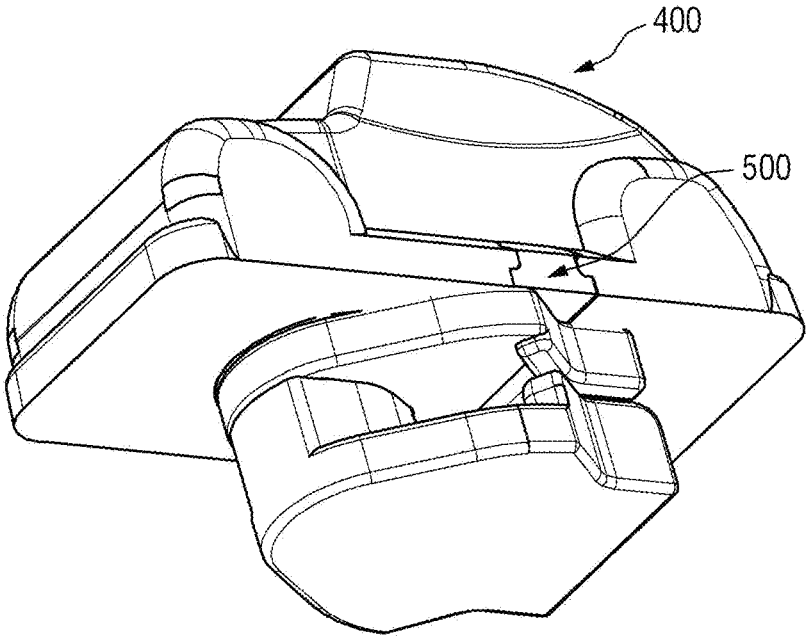
FIGS. 21 and 22 are coupled perspective views illustrating a zipper fastener to which the fastening bar according to the present invention is fastened.
Figure 22:
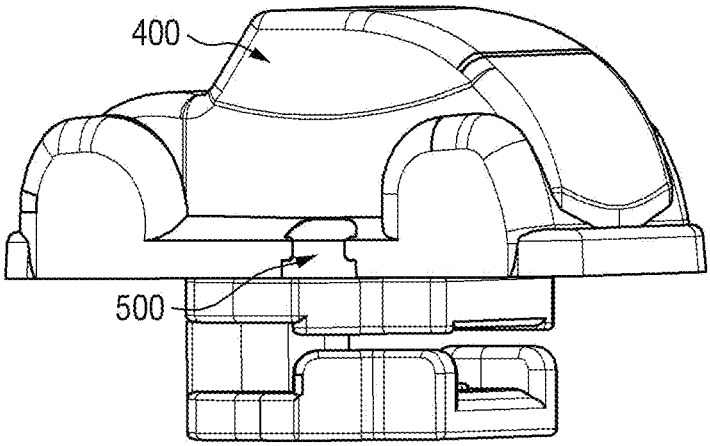
Figure 23:
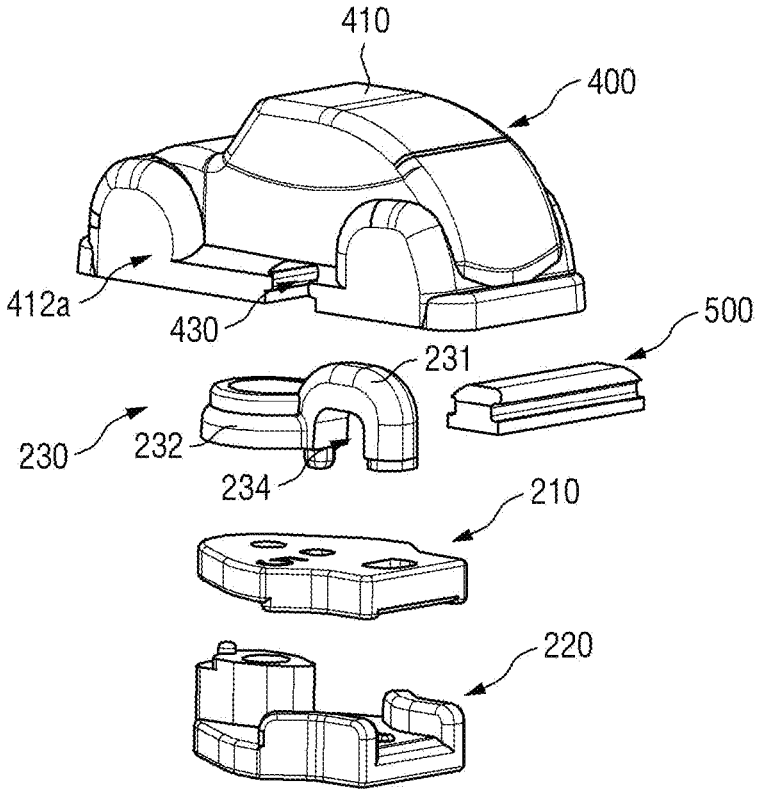
FIGS. 23 and 24 are exploded perspective views illustrating the zipper fastener to which the fastening bar according to the present invention is fastened.
Figure 24:
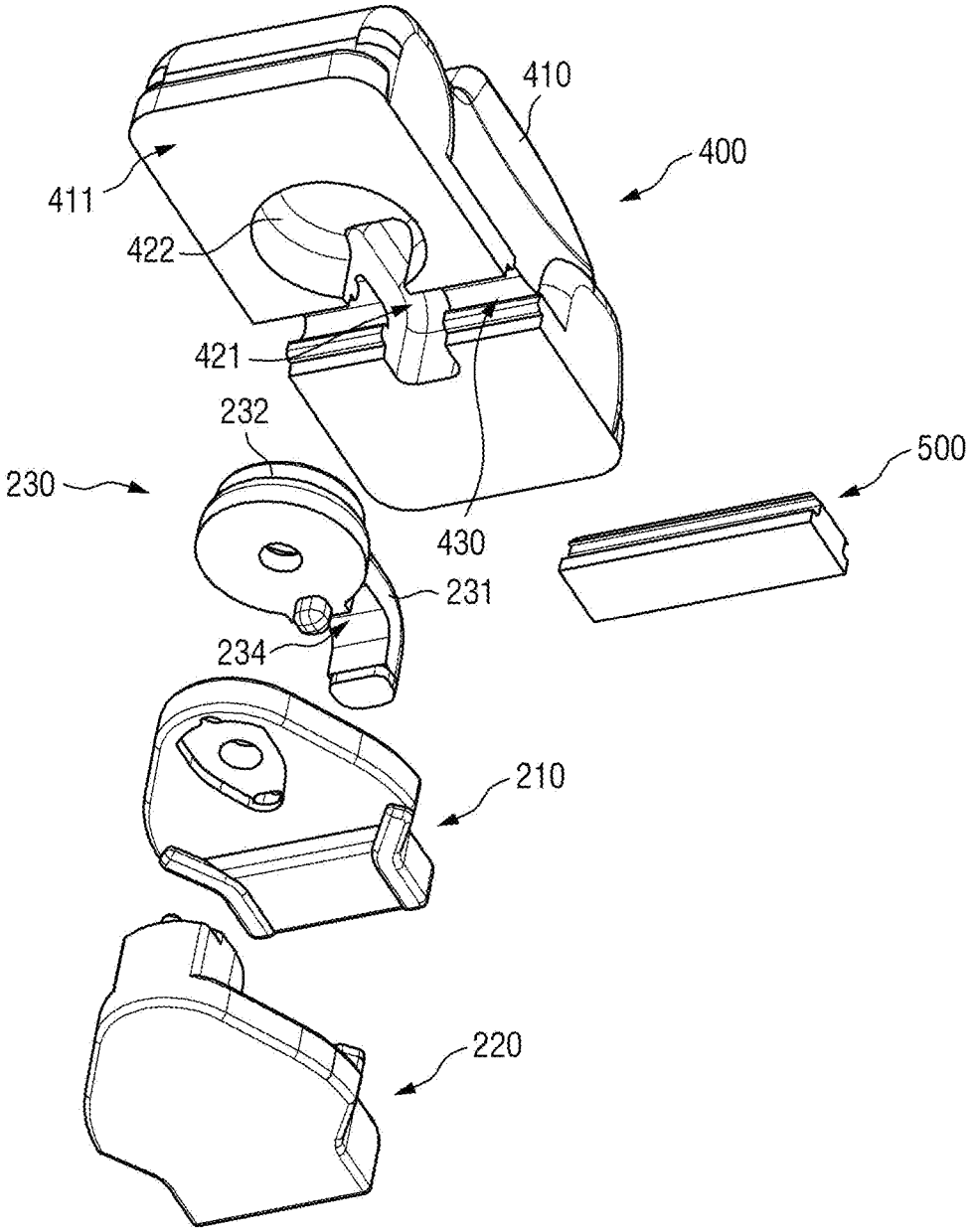
Figure 25:
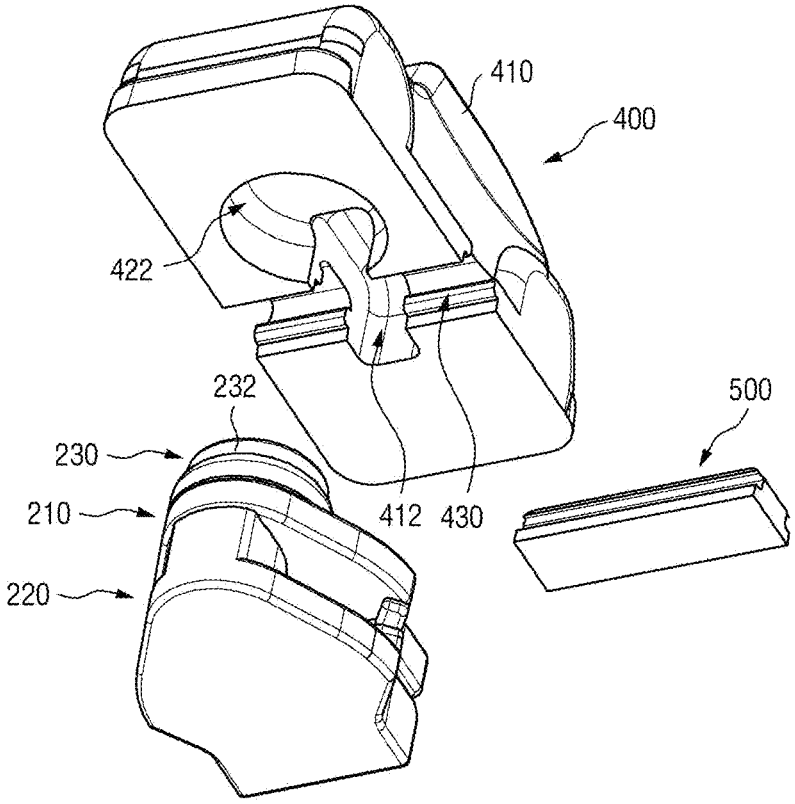
FIGS. 25 and 26 are partial coupled perspective views illustrating the zipper fastener to which the fastening bar according to the present invention is fastened.
Figure 26:
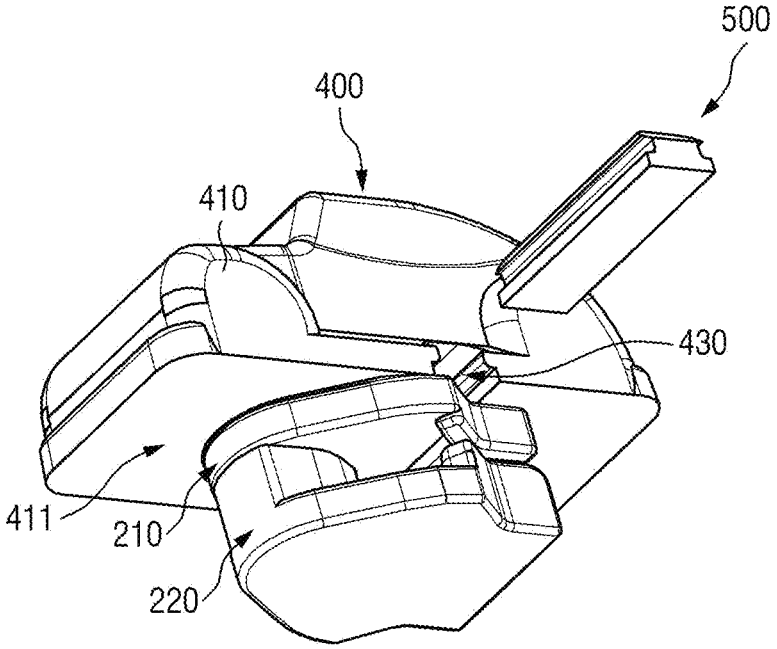

FIGS. 21 and 22 are coupled perspective views illustrating a zipper fastener to which the fastening bar according to the present invention is fastened, FIGS. 23 and 24 are exploded perspective views illustrating the zipper fastener to which the fastening bar according to the present invention is fastened, and FIGS. 25 and 26 are partial coupled perspective views illustrating the zipper fastener to which the fastening bar according to the present invention is fastened.

Since configurations of the zipper fastener in FIGS. 21 to 26, except for the fastening bar, may be referenced to FIGS. 1 to 5 described above, detailed descriptions thereof will be omitted.

As illustrated in FIGS. 21 to 26, while the upper plate 210, the lower plate 220, and the head 230 are fastened to one another, the body portion 231 of the head 230 is held in the body portion accommodation 421 of the main body portion 410 of the pull body 400, and the flange portion 232 of the head 230 is held in the flange portion accommodation 422 of the main body portion 410.

Then, the pull body 400 according to the present invention may be fastened to the head 230 as the fastening bar 500 according to the present invention is inserted into the fastening groove 430 of the main body portion 410 of the pull body 400.

In this case, in fastening the pull body 400 according to the present invention to the head 230, the main body portion lower surface 411 disposed at the lower portion of the main body portion 410 comes into contact with the upper surface of the first base plate 211 of the upper plate 210.

Also, in the present invention, when the body portion 231 of the head is disposed in the body portion accommodation 421, the fastening groove 430 is disposed on the same plane as the pull tab accommodation 234 formed due to the semi-annular shape of the body portion 231. Therefore, in order to allow the body portion 231 of the head to be disposed in the body portion accommodation 421 while the fastening groove 430 is disposed on the same plane as the pull tab accommodation 234 formed due to the semi-annular shape of the body portion 231, the depth of the body portion accommodation 421 is formed to be deeper than the depth of the fastening groove 430.

According to the present invention described above, since the head is separable from the upper plate in the present invention, the pull tab is replaceable, and thus, pull tabs of various forms are applicable to the zipper fastener according to the user's moods or needs.

Also, in the present invention, on the premise that the pull tab is replaceable, the pull tabs of general forms illustrated in FIGS. 12 to 14 may be removed and then replaced with the pull body including the main body portion which may be configured in shapes of various characters such as that illustrated in FIGS. 15 to 17 or that illustrated in FIG. 27 described above.

Embodiments of the present invention have been described above with reference to the accompanying drawings, but those of ordinary skill in the art to which the present invention pertains should understand that the present invention may be practiced in other specific forms without changing the technical idea or essential features of the present invention. Therefore, the above-described embodiments should be understood as being illustrative in all aspects rather than being restrictive.

The invention claimed is:

1. A zipper fastener comprising:

an upper plate;

a lower plate disposed to correspond to the upper plate;

a head disposed in a predetermined region of an upper surface of the upper plate; and a pull body configured to be fastened to the head, wherein the head includes a body portion and a flange portion extending to one side end of the body portion, the pull body includes a main body portion, the main body portion includes a main body portion lower surface disposed at a lower portion of the main body portion, a main body portion first side surface disposed at a first side of the main body portion, and a main body portion second side surface disposed at a second side of the main body portion and disposed to face the main body portion first side surface, the main body portion includes a head accommodation formed in a direction toward an inside of the main body portion from the main body portion lower surface, the head accommodation includes a body portion accommodation configured to hold the body portion of the head and a flange portion accommodation configured to hold the flange portion of the head, the main body portion includes a fastening groove extending in a direction toward the main body portion second side surface from the main body portion first side surface or extending in a direction toward the main body portion first side surface from the main body portion second side surface, the upper plate includes a first base plate, and the main body portion lower surface comes into contact with the upper surface of the first base plate, wherein:

the fastening groove includes a region overlapping with the body portion accommodation; and a depth of the body portion accommodation is formed to be deeper than a depth of the fastening groove.

2. The zipper fastener of claim 1, further comprising a fastening bar configured to be inserted into the fastening groove of the pull body.

3. A zipper fastener comprising:

an upper plate;

a lower plate disposed to correspond to the upper plate;

a head disposed in a predetermined region of an upper surface of the upper plate; and a pull body configured to be fastened to the head, wherein the head includes a body portion, the pull body includes a main body portion, the main body portion includes a main body portion lower surface disposed at a lower portion of the main body portion, a main body portion first side surface disposed at a first side of the main body portion, and a main body portion second side surface disposed at a second side of the main body portion and disposed to face the main body portion first side surface, the main body portion includes a head accommodation formed in a direction toward an inside of the main body portion from the main body portion lower surface, the head accommodation includes a body portion accommodation configured to hold the body portion of the head, the main body portion includes a fastening groove extending in a direction toward the main body portion second side surface from the main body portion first side surface or extending in a direction toward the main body portion first side surface from the main body portion second side surface, the upper plate includes a first base plate, and the main body portion lower surface comes into contact with the upper surface of the first base plate, wherein:

the fastening groove includes a region overlapping with the body portion accommodation; and a depth of the body portion accommodation is formed to be deeper than a depth of the fastening groove.

4. The zipper fastener of claim 3, further comprising a fastening bar configured to be inserted into the fastening groove of the pull body.

5. A pull body of a zipper fastener, the pull body comprising a main body portion, wherein:

the main body portion includes a main body portion lower surface disposed at a lower portion of the main body portion, a main body portion first side surface disposed at a first side of the main body portion, and a main body portion second side surface disposed at a second side of the main body portion and disposed to face the main body portion first side surface;

the main body portion includes a head accommodation formed in a direction toward an inside of the main body portion from the main body portion lower surface; and the main body portion includes a fastening groove extending in a direction toward the main body portion second side surface from the main body portion first side surface or extending in a direction toward the main body portion first side surface from the main body portion second side surface, wherein:

a head of the zipper fastener includes a body portion and a flange portion extending to one side end of the body portion; and the head accommodation includes a body portion accommodation configured to hold the body portion of the head and a flange portion accommodation configured to hold the flange portion of the head, and wherein:

the fastening groove includes a region overlapping with the body portion accommodation; and a depth of the body portion accommodation is formed to be deeper than a depth of the fastening groove.

6. The pull body of claim 5, wherein:

the zipper fastener includes an upper plate including a first base plate; and the main body portion lower surface comes into contact with an upper surface of the first base plate of the upper plate.

* * * * *